United States Patent [19]

Bergman

[11] Patent Number: 4,909,771

[45] Date of Patent: Mar. 20, 1990

[54] BRASSIERE

[75] Inventor: Alan Bergman, London, England

[73] Assignee: Dansport International Limited, London, United Kingdom

[21] Appl. No.: 112,247

[22] Filed: Oct. 21, 1987

[51] Int. Cl.[4] ..... A41C 3/00

[52] U.S. Cl. ..... 450/003; 450/66; 450/70

[58] Field of Search ..... 2/113; 450/1, 3, 70, 450/83, 92, 93; D2/1

[56] References Cited

U.S. PATENT DOCUMENTS

| | | | |
|---|---|---|---|
| 647,154 | 4/1900 | Phillips | 2/113 |
| 1,276,266 | 8/1918 | Quems | 2/113 |
| 1,434,944 | 11/1922 | Cooper | 450/92 |
| 2,707,284 | 5/1955 | Artzt | 2/113 |
| 3,628,539 | 12/1971 | Fredricks | 450/3 |
| 3,718,143 | 2/1973 | Pagano | 450/75 |
| 4,174,717 | 11/1979 | Schreiber et al. | 450/70 |
| 4,289,137 | 9/1981 | Dell | 450/58 |
| 4,311,150 | 1/1982 | Schreiber et al. | 450/70 |
| 4,341,219 | 7/1982 | Kuznetz | 450/74 |
| 4,510,626 | 4/1985 | Bowditch | 2/113 |
| 4,538,614 | 9/1985 | Henderson | 450/70 |
| 4,583,544 | 4/1986 | Flanagan | 450/58 |

FOREIGN PATENT DOCUMENTS

| | | |
|---|---|---|
| 0286156 | 3/1928 | United Kingdom . |
| 0408478 | 4/1934 | United Kingdom . |
| 0449787 | 7/1936 | United Kingdom . |
| 0452307 | 8/1936 | United Kingdom . |
| 0485918 | 5/1938 | United Kingdom . |
| 0486475 | 6/1938 | United Kingdom . |
| 1221932 | 2/1968 | United Kingdom . |
| 1406743 | 7/1975 | United Kingdom . |

OTHER PUBLICATIONS

Spiegel Spring Catalog, p. 186, 1985.
J. C. Penney Spring/Summer Catalog, 1981, p. 231.
Sears, Spring/Summer, 1978, p. 206.
Carton for Minimal Bounce Bra (Photocopy).
Copy of article from "Workout", Oct. 1987.

*Primary Examiner*—Werner H. Schroeder
*Assistant Examiner*—Jeanette E. Chapman
*Attorney, Agent, or Firm*—Ladas & Parry

[57] ABSTRACT

An improved brassiere (1) in which the part (2) which supports the breasts is made of a fabric, preferably cotton/Lycra*, which is initially flat but which, without the use of seams, darts, mouldings or shaping, stretches around and generally conforms to the shape of the wearer's breasts to hold them against her body. A feature of the preferred bra is that it is devoid of all hardware such as clips or buckles and it includes a wide midrif portion at the front, sides and back (15,16) for improved support.

13 Claims, 2 Drawing Sheets

BRASSIERE

This invention relates to brassieres, and more particularly, but not exclusively to bras for use in high activity or strenuous exercise applications such as dancing and all forms of sport.

Conventional bras are generally of the suspensory harness type in that the breasts rest in cups that are suspended by straps attached thereto which themselves are attached to an anchoring structure in the form of a narrow back strap which is of inadequate mass to sufficiently counter the downward and opposite pull of the breast mass. As a result, two undesirable actions occur. The back of the bra (for reasons explained above) rides up and the breast mass moves up and down.

For normal everyday use, this unwanted movement, whilst not desirable is not a particular problem, but if a bra of this type is to be used for high activity applications such as sport or dancing this movement is much more of a problem as the breast mass bounces up and down which, in addition to the obvious discomfort, results in the delicate suspensory ligaments known as Cooper's ligaments being gradually and irrevocably stretched. Nipple soreness also occurs.

Breast bounce can be reduced to some degree in a number of ways. The most commonly used methods are by increasing the thickness of the shoulder straps and/or their tension (by the use of adjustable hardware) and by various constructional devices such as seams, darts and the tension of the laterally attached elastic that connects the cup area to the back of the bra. However, as such bras are all still of an inadequately designed suspensory harness system, with the breast mass located in cups suspended from shoulder straps, painful breast bounce still occurs, particularly when the recovery properties of the elastic shoulder straps weaken due to frequent washing.

Another problem with known bras, whether they be of the standard vertical shoulder strap or the cross-over or Y type is that the straps are usually visible under the shoulder strap portion of the outer garment under which they are worn. This is particularly true of sleeveless leotards and sleeveless sports tops such as tennis or running tops whether they be of the boat, V or round neck variety. This is because the conventional bra strap either rests too near the neck or too near the shoulder or is too wide.

Additionally, and this is particularly true of the cross-over or Y type variety of bra, they are visible at the back in the case of garments with a standard cut back opening. Obviously, this visibility of the bra is aesthetically undesirable.

Also, the cross-over or Y strapped bra, like the vertical strapped bra, tends to ride up where the straps are attached for the same reasons as stated above. This obviously reduces to some degree whatever suspension they were meant to give.

Furthermore, the cross-over or Y strapped bra provides little or no lateral/horizontal support for the bust which is so important.

It is an object of the invention therefore to provide a bra which overcomes or substantially reduces all or most of these problems.

According to the invention there is provided a bra with shoulder straps in which at least the portion which supports the breasts is made of a piece of fabric which is initially flat but which, without the use of seams, darts, moulding or shaping, will stretch around and generally conform to the shape of the breast when inserted therein to hold the breast mass against the wearer's body.

The present invention represents a substantial departure from known bras because it has no shaped cups to receive the breasts. Instead, it effectively holds or clamps the breast mass to the wearer's chest to restrict its movement rather than suspend it in cups by means of the shoulder straps attached thereto.

Preferably, the whole of the bra including the shoulder straps is made of said fabric but it will be appreciated that some or all of the other component parts of the bra could be made of different materials.

Desirably, the fabric of the breast supporting portion and some or all of the rest of the bra is a cotton/Lycra* mixture.

In a preferred embodiment, the bra is made up from a front breast supporting portion and a rear portion, said front and rear portions being connected by one or more side seams depending on whether the front and rear portions are cut out as separate pieces of fabric or the whole bra is cut out from a single piece of fabric.

If the latter method is used the single sheet of fabric is laid flat and the front and rear portions with integrally formed one piece interconnectable straps are cut out as an effective mirror image of one another along the line through the straps other than for possible slight variations in neckline. The cut material is folded about the straps so that the separate front and rear portions overlie one another whereupon the opposed portions are attached to each other by stitching along respective adjacent side edges thereof.

Alternatively, in the laid out flat state of the fabric the front and rear portions can be integrally formed in one piece along one of the side seams referred to above in the embodiment as described. The straps for the front portion are cut separately from the straps for the rear portion but are integrally formed with their respective front or rear portions. When the front and rear portions are folded to overlie one another the portions are then attached by stitching along one seam and the respective front and back straps are interconnected by stitching.

In yet a further embodiment the front and rear portions with respective straps are formed separately from each other and sewn together with two side seams and with strap seams moving across the straps. In all embodiments, the sheet material can be formed in two or more layers for either the front or rear portions or both to increase the thickness of this sheet material.

Conveniently, the front and rear portions of the bra are designed and cut so that the shoulder straps sit on the wearer's shoulders some distance away from the wearer's neck but without sliding off the wearer's shoulders even under the most strenuous exercise conditions. This has the advantage of giving more directional support for the breast mass and it also means that the bra can be worn under garments with large neck openings without the shoulder straps being visible.

In the preferred bra, a band of rubber or elastic is additionally attached around the bottom, arm and neck openings of the bra.

An important feature of the preferred bra of the invention is that its front includes a breast supporting portion to actually hold the breast mass to the wearer's chest and below it, a midrif portion which enhances breast support and grips the wearer's torso below her breasts thereby reducing the risk of the front of the bra riding up and cutting or chaffing under the breasts. Similarly at the back of the bra, the rear portion is particularly wide and includes a midrif portion to provide good grip and location across the wearer's back. This wide back portion also serves to provide a counter balanced anchor point for the weight of the breast mass acting through the shoulder straps. In the preferred bra, the front and rear midrif portions are made from the same piece of fabric as the breast supporting portion and the rear portion.

A further important feature of the preferred bra of the invention is that it has no clips, buckles, hooks, constructional wiring, plastics supports or ventilation openings with their associated seams nor does it have any breast dividing or other stitching or seaming in the breast supporting portion. Thus, an extremely simple and comfortable bra is provided which gives excellent support and reduced irritation. For certain applications, it may be desirable to make the front only or the front and rear portions from a double thickness of said fabric.

A preferred bra of the invention will now be described, by way of example only, with reference to the accompanying drawings, in which.

Figure 1:
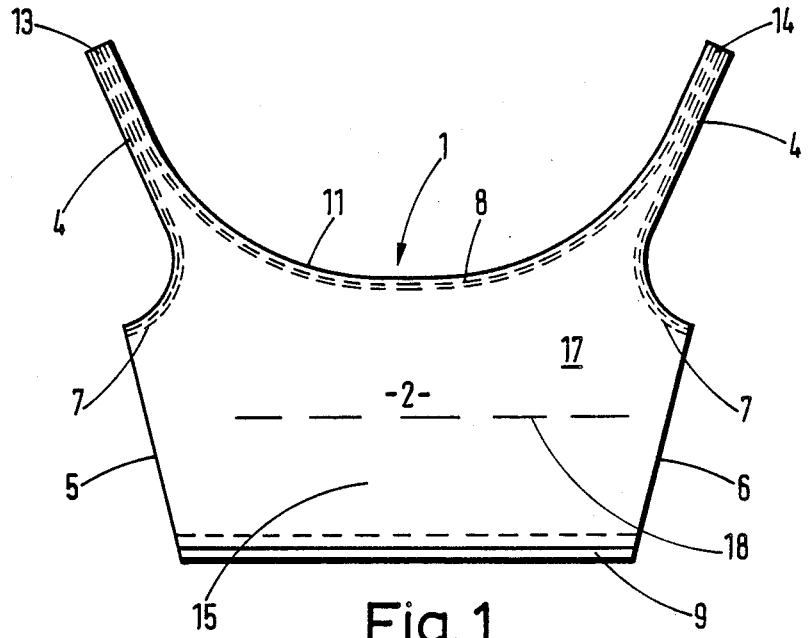
FIG. 1 is a front view of a bra of the invention.
Figure 2:
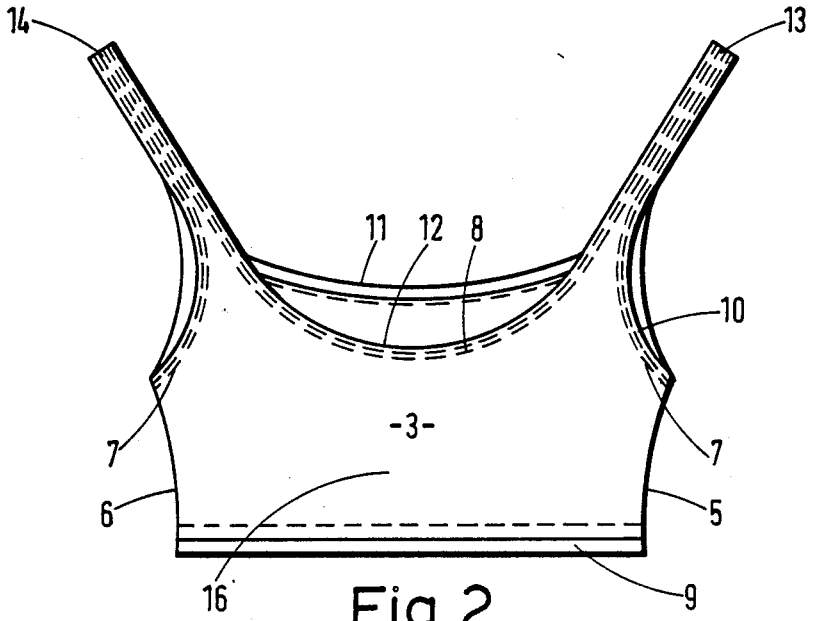
FIG. 2 is a rear view of the bra of FIG. 1.
Figure 3:
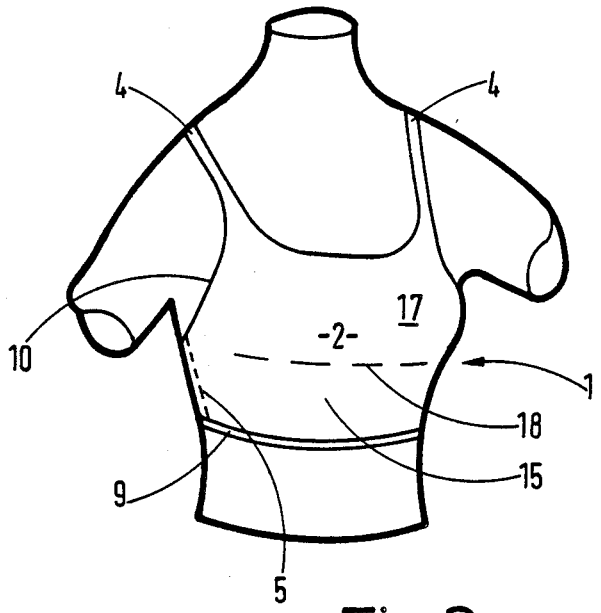
FIG. 3 is a perspective view of the bra of FIGS. 1 and 2 on a wearer's body.

Referring to FIGS. 1 to 3 of the drawings, there is shown a bra 1 comprising a front portion 2 and a rear portion 3 which are each provided with straps 4. In the illustrated bra, the front and rear portions (2,3) are cut from two separate pieces of fabric, preferably a cotton/Lycra$^{TM}$ mixture. Each front or rear portion 2,3 is cut out with its straps 4 and the two portions are then connected together by side seams 5,6 and strap seams 13,14. However, as previously referred to herein the bra can be cut out from a single piece of fabric in which the front and rear portions 2, 3 are interconnected by integral one piece straps 4 or alternatively, the front and rear portions are integrally formed in one piece along a line extending from arm hole 10 to the bottom edge of the bra. In this latter form the straps 4 of the front portions are separate from those of the rear portion and in the finished bra the straps are interconnected by strap steams 13,14.

When the bra is sewn together a strip of rubber or elastic 7 is overlocked around each arm opening 10. Similarly, a strip of rubber of elastic 8 is overlocked around each neck opening 11,12 of the front and rear portions, respectively, and a wider strip of elastic 9 is attached around the bottom of a midrif portion 15,16 of the bra below breast supporting portion 17. To illustrate the midrif and breast supporting portions of the front portion 2 more clearly a dotted line 18 shows an approximate dividing line between the two areas although such line is not present in any way shape or form in the finished article and is included here merely for ease of description.

It will be noted that unlike conventional bras which have very little material below the cups, the bra according to the present invention includes substantial front and rear midrif portions 15,16, respectively. These midrif portions grip the torso and prevent the bra from riding up. The midrif portions also provide excellent additional support and location for the breast mass due, in no small part, to their counterbalancing effect transmitted through the shoulder straps 4. For increased comfort and support, the under arm area 10 is cut away to provide an arm hole as large as possible for comfort and freedom of movement but which still leaves enough fabric at the side of the bra to provide lateral grip and support for the breast mass. The rear 3 of the bra can be cut lower than as illustrated if desired.

The main features of the illustrated bra which distinguish it from known bras are firstly that it is not a harness. It is specifically designed to hold the breast mass against the torso thereby reducing painful movement thereof. It is devoid of all hardware such as clips, hooks, buckles, constructional wiring or plastic supports which can dig into the wearer and be a source of discomfort. It is also devoid of seams, darts or ventilation openings with their associated seams in the breast supporting area 17 so nipple irritation is avoided. Also nylon is usually used in known bras for the ventilation openings and this material actually generates perspiration rather than absorbs it. By making the bra of the invention out of cotton/Lycra*, such ventilation openings are not needed as the cotton/Lycra* fabric absorbs perspiration and allows the skin to breath naturally as it is only the cotton/Lycra* fabric which touches the skin. As the breast supporting portion is made of a flat piece of stretch cotton/Lycra* material, without seams, darts, moulding or other shaping, manufacture is made much easier and it is much more comfortable to wear as there is no need for additional cups or linings. As the shoulder straps are preferably made of the same stretch cotton/-Lycra* fabric as the rest of the bra but reinforced with rubber or elastic, their stretch and recovery ability should last for the life of the garment.

The special design of the illustrated bra with its wide apart shoulder straps means that it can readily be worn under most sleeveless leotards and sleeveless sports tops such as tennis and running tops, which normally are fairly low or wide cut around the neck area 11,12, without the straps being visible. Its unique design also makes it aesthetically and socially acceptable as outerwear.

The bra is additionally shaped so that the back is of a lower height than the front so that when worn below a garment having a usual low cut back the rear of the bra cannot be seen. The ratio of the height of the rear portion of the bra relative to the front portion of the bra is less than 60%, the rear portion being lower in height. "Lycra" is Dupont's Registered Trade Mark for its elastane fibre.

I claim:

1. An exercise bra for women during strenuous exercise comprising a front portion having a flat breast supporting portion which supports the breast by clamping the breast mass against the wearer's chest and a midrif portion extending downwardly well below the breast supporting portion to enhance breast support and to grip the wearer's torso firmly below her breasts, a rear portion connected to the front portion by at least one seam, and shoulder straps extending between the front and rear portions, the breast supporting portion and midrif portion being formed from a single piece of fabric which without the use of seams, darts, moulding, shaping or breast dividing stitching stretches around and generally conforms to the flattened shape of the breast and in use clamps the breast mass against the wearer's body, the piece of fabric including the front and rear portions comprising a double thickness of the fabric.

2. A bra is claimed in claim 1 wherein the whole of the bra including the shoulder straps is made of said fabric.

3. A bra as claimed in claim 1 wherein said fabric is a cotton/Lycra* mixture.

4. A bra as claimed in claim 1, wherein the front and rear portions are interconnected by one side seam.

5. A bra as claimed in claim 1 wherein the front and rear portions are interconnected by two side seams, one at each opposed side of the bra.

6. A bra as claimed in claim 1 wherein the whole bra is made of a single piece of said fabric.

7. A bra as claimed in claim 1, wherein the front and rear portions are connected at a single side seam, the straps being formed separately with each front and rear portion and being joined together by a respective strap seam.

8. A bra as claimed in claim 1 wherein the front and rear portions of the bra are designed and cut so that the shoulder straps sit on the wearer's shoulders some distance away from the wearer's neck.

9. A bra as claimed in claim 1 wherein a band of rubber or elastic is attached around the bottom of the bra, the arm openings and the head/neck opening.

10. A bra as claimed in claim 1 without clips, hooks, buckles, constructional wiring, plastic supports or ventilation openings with their associated seams.

11. A bra as claimed in claim 1 in which the breast supporting portion is devoid of any breast dividing stitching, seaming or darts.

12. A bra as claimed in claim 4 in which the rear portion is particularly wide and includes a midrif portion.

13. A bra as claimed in claim 1 wherein the sides of the bra are of a width sufficient to provide additional pull to hold the breast mass to the wearer's chest.

* * * * *